US005332545A

United States Patent [19]

Love

[11] Patent Number: 5,332,545

[45] Date of Patent: Jul. 26, 1994

[54] METHOD OF MAKING LOW COST TI-6A1-4V BALLISTIC ALLOY

[75] Inventor: William W. Love, LaHabra Heights, Calif.

[73] Assignee: RMI Titanium Company, Niles, Ohio

[21] Appl. No.: 39,901

[22] Filed: Mar. 30, 1993

[51] Int. Cl.[5] ..... C22C 14/00

[52] U.S. Cl. ..... 420/420; 148/421; 148/670; 420/418

[58] Field of Search ..... 420/418, 420; 148/421, 148/670

[56] References Cited

U.S. PATENT DOCUMENTS 4,675,055 6/1987 Ouchi et al. ..... 148/670

OTHER PUBLICATIONS

Charles F. Hickey, Jr., and Albert A. Anctil, Mar. 1980 "Ballistic Damage Characteristics and Fracture Toughness of Laminated Aluminum 7049-T73 and Titanium 6AI-4V Alloys", Army Materials and Mechanics Research Center.

Military Specification, "Armor Plate, Titanium Alloy, Weldable", MIL-A-46077D Apr. 28, 1978.

Military Specification, "Titanium Alloy Armor Plate, Weldable", MIL-T-46077B Jul. 15, 1975.

*Primary Examiner*—Upendra Roy

*Attorney, Agent, or Firm*—Scully, Scott, Murphy & Presser

[57] ABSTRACT

The present invention relates to a low cost process for providing equivalent or superior ballistic resistance performance compared to standard Ti-6Al-4V alloys. The present inventions process involves increasing the oxygen content of Ti-6Al-4V beyond the conventional limit of 0.20% maximum reported for prior art compounds and subsequently thereafter heating the oxygen rich titanium alloy at temperatures within the beta phase field for further processing.

Additionally, the present invention provides a novel Ti-6Al-4V alloy composition which exhibits improved tensile and yield strength properties. Titanium compositions of the present invention exhibit improved ballistic properties compared to titanium compositions previously disclosed in the art. The novel Ti-6Al-4V composition of the present invention is obtained by modifying the alloy composition limits to 5.5 to 6.75% Al, 3.5 to 4.5% V, 0.20 to 0.30% $O_2$, <0.50% Fe and 0.50% other unavoidable impurities; and then heating the alloy composition to temperatures within the beta-phase field for further processing. Titanium alloys having the above composition are extremely useful as armor plates.

13 Claims, No Drawings

METHOD OF MAKING LOW COST TI-6A1-4V BALLISTIC ALLOY

FIELD OF THE INVENTION

The present invention concerns a low cost process for providing equivalent or superior ballistic performance compared to standard alloys of titanium which are utilized as armor plates for military applications. More specifically, the process of the present invention relates to increasing the oxygen content of Ti-6Al-4V alloy composition beyond the conventional range of 0.20% maximum and processing this oxygen rich titanium alloy composition using furnace temperatures within the beta phase field. The invention also relates to novel titanium alloy compositions having improved yield and tensile strength prepared by the process of the present invention. The novel titanium alloys of the present invention are characterized as having an oxygen content from about 0.20 to about 0.30%.

DESCRIPTION OF THE PRIOR ART

Titanium, and in particular the alloy Ti-6Al-4V are widely recognized materials for use as armor plates due to the good ballistic resistance properties of these materials. This characteristic has resulted in several applications and the generalization of *Military Specification Titanium Alloy Armor Plate, Weldable*; Jul. 15, 1975 (MIL-T-46077B) which is well recognized in the art as a purchase specification for armor plates processed from the Ti-6Al-4V alloy. This military specification states that the maximum amount of oxygen which may be present in the titanium alloy composition of the armor plate should not exceed 0.14%. The reason for this requirement is that any armor plate processed from an oxygen rich titanium alloy would on the basis of prior art understanding be expected to exhibit poor ballistic performance. Thus, for military applications, the oxygen content of the titanium alloy is understood not to exceed this maximum limit of 0.14% since higher amounts of oxygen present in the titanium alloy would be expected to lower the ductility and, more importantly, lower the ballistic performance of the armor plate itself.

The current state of the art, as embodied in the MIL-T-46077B specification, results in the use of both costly raw materials and processing. The MIL-T-46077B limit of 0.14% oxygen maximum precludes the use of large amounts of low cost scrap in the ingot consolidation since these materials have an oxygen content beyond the limit specified by the military. Although this specification does not define the processing step used in preparing its final product, the high minimum tensile elongations reported therein require a low temperature, costly alpha+beta processing and annealing.

This low temperature, alpha+beta processing technique is normally used for the final 60 to 80% reduction of the material and is employed to enhance the ballistic properties of the armor plate. As indicated hereinabove, this technique is costly because of the numerous reheating steps required to process the final plate. Moreover, the surface of the armor plate containing the titanium alloy has a greater tendency to crack at the low temperatures employed by this process. Thus, continued research is ongoing to develop a low cost Ti-6Al-4V ballistic alloy which exhibits improved ballistic resistance.

Hickey, Jr. et al., *Ballistic Damage Characteristics and Fracture Toughness of Laminated Aluminum* 7049-*T*73 *and Titanium 6Al-4V Alloys*, Army Materials and Mechanics Research Center, Watertown, Mass., March 1980, pp. 1–12 discloses the ballistic properties of Ti-6Al-4V laminates which are processed by a solution treatment step and an aging treatment step. The solution treatment step involves heating the titanium alloy to temperatures from 1850°–1990° F. for 15 minutes, air cooling, and then heating to 1775° F. for 1 hour. The aging step involves heating the solution treated titanium alloy to 1300° F. for 1 hour. The oxygen content of Ti-6Al-4V laminate was determined to be 0.13 wt. % which is below the level specified in the MIL-T-46077B specification, therefore, the laminate was expected to exhibit good ballistic performance.

By way of background and for convenience the terms alpha, beta, and alpha-beta titanium base alloys will be discussed hereinbelow.

It is well known in the art that the addition of alloying elements alters the $\beta$-transformation temperature in the phase diagram of titanium alloy systems. The $\beta$-transformation temperature is the lowest temperature where 100% beta phase exists. Below this temperature, the alpha phase can exist.

Elements that raise the transformation temperature are called $\alpha$-stabilizers whereas elements that depress the transformation temperatures are called $\beta$-stabilizers. The $\beta$-stabilizers are further divided into $\beta$-isomorphous and $\beta$-eutectoid types. The $\beta$-isomorphous elements have limited $\alpha$-solubility and increasing additions of these elements progressively depresses the transformation temperature. The $\beta$-eutectoid elements have restricted beta solubility and form intermetallic compounds by eutectoid decomposition of the $\beta$-phase.

The important $\alpha$-stabilizing elements include aluminum, tin, zirconium and the interstitial elements oxygen, nitrogen and carbon. Small quantities of these interstitial elements, generally considered to be impurities, have a great effect on the strength of the alloy and ultimately embrittle it at room temperature. The most important $\alpha$-stabilizer is aluminum and the addition of this $\alpha$-stabilizer to titanium results in increased strength of the titanium material.

The important $\beta$-stabilizing alloying elements are the body centered cubic (bcc) elements vanadium, molybdenum, tantalum, and niobium of the $\beta$-isomorphous type and manganese, iron, chromium, cobalt, nickel, copper and silicon of the $\beta$-eutectoid type. The elements copper, silicon, nickel, and cobalt are termed active eutectoid forms because of a rapid decomposition of $\beta$ to $\alpha$ and a compound.

Alloys of the $\beta$-type respond to heat treatment, are characterized by a higher density than pure titanium and are easily fabricated by cold working. The purpose of $\beta$-alloying is to form an all $\beta$-phase alloy at room temperature with commercially useful qualities, form alloys with duplex $\alpha$ and $\beta$ structure to enhance heat-treatment response (i.e., changing the $\alpha$ and $\beta$ volume ratio), or the use of $\beta$-eutectoid elements for intermetallic hardening. The most important commercial $\beta$-alloying element is vanadium.

The following references disclose various titanium base alloy compositions that are known in the art, however, none of these references disclose the inventive method or composition of the present invention.

U.S. Pat. No. 2,754,204 to Jaffee et al. provides a strong, ductile and thermally stable, titanium-base alloy containing as essential constituents, aluminum, together with one or more elements selected from the group consisting of vanadium, columbium and tantalum. The oxygen content of the titanium alloy compositions disclosed in this reference does not exceed 0.20%. These titanium base alloys are said to have excellent welding characteristics and do not become brittle when exposed to high temperatures for a prolonged period of time. The titanium alloys disclosed in this reference are made by melt casting in a cold mold, employing an electric arc in an inert atmosphere, or by other means in which the alloy is rendered molten before casting.

U.S. Pat. No. 2,884,323 to Abkowitz et al. relates to titanium base alloys and more particularly to quaternary titanium base alloys containing aluminum, vanadium, iron and significant amounts of oxygen. Moreover, this reference provides a titanium based alloy consisting of 0.80–1.8% Al, 7.5–8.5% V, 4.5–5.5% Fe, 0.30–0.50% $O_2$, and the balance being incidental impurities. The quaternary titanium base alloys are said to have high tensile strength while retaining adequate elongation and bend ductility.

U.S. Pat. No. 4,898,624 to Chakrabarti et al. relates to titanium alloys having improved mechanical properties rendering these alloys more useful as rotating components such as impellers, disks, shafts and the like for gas turbines. The Ti-6Al-4V alloys which can be used to obtain the improved properties have the following general composition: 5.5–6.75% Al, 3.5–4.2% V, 0.15–0.20% $O_2$, 0.025–0.05% N, 0.30% Fe, and minor amounts of another unavoidable impurities. To obtain the desired microstructure, the alloy composition is preheated above the beta-transus temperature for a sufficient time and temperature followed by fast cooling. Thereafter, the alloy is then aged to precipitate some fine alpha particles and to strengthen and stabilize the microstructure of the alloy.

U.S. Pat. No. 4,943,412 to Bania et al. provides an alpha-beta titanium base alloy comprising, in weight percent, 0.04–0.10% silicon and 0.03–0.08% carbon. The alloys disclosed in this reference are characterized as having an increased strength compared to alloys that do not add silicon and carbon additives. Furthermore, the alloys may additionally comprise up to 0.30% Fe and up to 0.25% $O_2$. The alloy compositions are first rolled and then beta annealed to obtain the final product.

U.S. Pat. No. 5,032,189 to Eylon et al. relates to near-alpha (i.e., $<2\%$ $\beta$-stabilizers) and alpha+beta titanium alloy components which are produced by a process which comprises the steps of forging an alloy billet to a desired shape at a temperature above the beta-transus temperature of the alloy to provide a forged component, heating the forged component at a temperature approximately equal to the beta-transus temperature of the alloy, cooling the component at a rate in excess of air cooling to room temperature, annealing the component at a temperature about 10 to 20% below the beta-transus temperature, and cooling the component in air.

As indicated previously hereinabove, none of the references disclosed herein relates to a low-cost process for achieving improved ballistic performance of conventional Ti-6Al-4V by increasing the oxygen content of this alloy beyond the normal range of 0.20% and processing the final product into a plate using furnace temperatures in the beta phase field. The beta phase field is the area of the phase diagram wherein the primary phase present in the titanium alloy will be beta.

SUMMARY OF THE INVENTION

The present invention relates to a low cost process for providing equivalent or superior ballistic resistance performance of standard Ti-6Al-4V alloys. The present inventive process involves increasing the oxygen content of Ti-6Al-4V beyond the conventional limit of 0.20% maximum reported for prior art compounds and subsequently thereafter heating the oxygen rich titanium alloy at temperatures within the beta phase field. This affords the benefit of permitting higher oxygen level scrap of generally lower cost to be reprocessed with virgin material without sacrificing ballistic performance of armor plate based therein.

Additionally, the present invention provides a novel Ti-6Al-4V alloy composition which exhibits equivalent tensile and yield strength properties for beta processed material. Furthermore, titanium compositions of the present invention exhibit equivalent or improved ballistic properties compared to titanium compositions previously disclosed in the art. The novel Ti-6Al-4V composition of the present invention is obtained by modifying the alloy composition limits to 5.5 to 6.75% Al, 3.5 to 4.5% V, 0.20 to 0.30% $O_2$, $<0.50\%$ Fe and $<0.50\%$ other impurities; and then heating the alloy composition to temperatures within the beta-phase field.

DETAILED DESCRIPTION OF THE INVENTION

In accordance with the present inventive method, a low cost process for improving the ballistic performance of standard Ti-6Al-4V is provided. The first step of the instant invention involves modifying the composition limits of the titanium base alloy to the following limits: (a) 5.5 to 6.75% Al; (b) 3.5 to 4.5% V; (c) 0.20 to 0.30% $O_2$; (d) 0.50 Max. Fe; and (e) 0.50% Max. of other impurities.

In a preferred embodiment of the present invention, the composition limits of the titanium alloy are modified to 6.2% Al; 4.0% V, 0.25% $O_2$; and 0.20% Fe. The other impurities which may be present in the titanium base alloy include one or more of the following beta-stabilizing elements Cr, Ni, Mo and Cu. As mentioned previously hereinabove, the total amount of these impurities in the titanium alloy composition should not exceed 0.50%. Preferably, the total amount of unavoidable impurities does not exceed 0.30%.

This modification of increasing the content of oxygen beyond the range normally specified by standard military guidelines is preferably done by using low cost scrap Ti-6Al-4V alloy material. Other means for increasing the oxygen content beyond 0.20% include the use of large or small milled or finished articles, turnings, cuttings, chips, chunks, powders and the like. The low cost titanium scrap materials which are oxygen rich are especially suitable for this process, however, prior to their use the scrap metal should be cleaned if necessary with detergents, organic solvents, or by other methods known in the art to remove oil and greases. Undesired metal contaminants such as drill bits can be physically or mechanically removed. The cleaned material should also be dried if necessary to remove moisture.

The total amount of oxygen rich material that can be tolerated by the present invention for applications as armor plates is from about 25 to about 100%. More preferably, the total amount of oxygen rich material present in the composition is from about 60 to about 100%. Most preferably, the total amount of oxygen rich material that can be tolerated in the present invention is 100%.

The oxygen rich titanium material is then melted one time to produce a slab having a desired thickness. The term oxygen rich is used herein to denote that the content of oxygen in the titanium alloy is beyond the 0.20% maximum limit specified by the military specification. The melting process of this oxygen rich titanium-containing material may be conducted by conventional methods well known in the art, such as by a single electron beam (EB) melt process, plasma melt or the likes thereof. The preferred method of melting the oxygen rich titanium composition is by employing a single hearth melt process. This melt process may be conducted under vacuum or an inert gas atmosphere. The inert gases which may be employed by the single melt process include He, Ar and the likes thereof.

The single hearth melt process basically involves melting the oxygen rich titanium containing material in a cold-mold hearth furnace by employing an electron beam or plasma energy sources. The melt conditions employed by the single hearth melt process are effective to cause sufficient liquidification of the oxygen rich titanium material. More preferably, a homogeneously melted oxygen rich Ti-6Al-4V slab is directly cast from the hearth furnace.

After melting the oxygen rich titanium material into a slab, the slab is then cooled to ambient. The cooling process may be conducted in air, an inert gas atmosphere or under vacuum.

The size and shape of the thus formed oxygen rich Ti-6Al-4V slab can vary depending on the desired application of the final product. Likewise, the thickness of the slab may also vary depending only on the desired application of the final product.

The slab containing the oxygen rich Ti-6Al-4V material is then processed to the final product by employing heating temperatures within the beta field range. By beta field range, we mean a temperature above the beta transus of the slab being processed. More specifically, the Ti-6Al-4V slab is then heated to temperatures from about 990° to about 1200° C. for a period of time from about 1 to about 12 hrs. More preferably, the Ti-6Al-4V slab is heated at temperatures from about 1050° to about 1100° C. for a period of time from about 3 to about 6 hrs. Most preferably, the oxygen rich slab is heated at 1075° C. for 4 hrs.

Subsequently (after heating the slab at temperatures within the beta phase field) the beta treated Ti-6Al-4V slab is then rolled to form a plate having a thickness of about 3/16 to about 6 inches. More preferably, the beta processed slab is rolled to a thickness of about 1 to about 3 inches. Most preferably, the beta process oxygen rich titanium containing slab is rolled into a 1.5 inch thick plate.

The plate may then be conditioned if necessary by any of the methods well known in the art. These conditioning methods include sandblasting, spot grinding or pickling. The conditioned plate may then be vacuum annealed and heat treated if necessary using conventional methods well known in the art.

The ballistic testing on the present oxygen rich titanium plates are conducted at the Army Research Laboratory (Aberdeen Proving Grounds, Md.) according to a protocol previously reported in *Military Specification Titanium Alloy Armor Plate, Weldable*; Apr. 28, 1978 (MIL-A-46077D) the contents which are incorporated herein by reference. The $V_{50}$ ballistic limit used to report the ballistic properties of the plates is the velocity where 50% perforations are expected with a specific round and a specific target. Higher numbers infer better ballistic performance.

The following examples are given to illustrate the scope of the invention. Because these examples are given for illustrative purposes only, the invention embodied therein should not be limited thereto.

EXAMPLE I

A scrap of Ti-6Al-4V having an oxygen content of 0.22% was cleaned with detergents to remove any oil or grease which may be present in this scrap material. After the cleaning process was conducted, the oxygen rich titanium scrap material was then dried to remove moisture which may be present on the surface of the material.

The dried scrap of Ti-6Al-4V was then placed into a feeding jig of a cold-mold hearth furnace and then subjected to a single electron beam (EB) melt process. The single EB melt process was conducted at a temperature sufficient to cause liquidification of the scrap material. The melted oxygen rich titanium containing composition was then cooled in the furnace and finally in air to room temperature to form a slab of Ti-6Al-4V having a thickness of about 12 inches.

The slab was then $\beta$-processed at a temperature of about 1070° C. for 4 hrs. and thereafter cooled to room temperature. Thereafter, the $\beta$-processed Ti-6Al-4V slab was then beta rolled to form a plate having final thickness of 1.5 inch.

The physical properties of the oxygen rich Ti-6Al-4V armor plate which was beta processed at high temperatures are illustrated in Table I. The Ti-6Al-4V armor plates' physical properties were tested in both the longitudinal (L) and transverse (T) directions. The normalized ballistic rating, $V_N$, for the plate was determined to be 1046. The tensile strength (UTS) and the yield strength (YS) in the longitudinal direction of the formed plate having an oxygen content of 0.22% was determined to be 142 KSI and 126 KSI, respectively. The same armor plate when tested in the transverse direction had a UTS of 147 KSI and a YS of 135 KSI.

The results clearly demonstrate that high ballistic performance can be achieved by employing a high oxygen, $\beta$ processed plate. This result was totally unexpected based on prior art findings and conventional wisdom since high oxygen content was envisioned to adversely affect the armor plate.

EXAMPLE II

A Ti-6Al-4V plate having a thickness of 1.5 inch was prepared in accordance with the procedure described in Example I except that an ingot meeting the traditional requirements of standard specification Ti-6Al-4V was employed. The ingot had an $O_2$ content of 0.15% which is within the limit specified in the military specification.

The physical properties of this plate are illustrated in Table I. The normalized ballistic rating, $V_N$, of this Ti-6Al-4V plate was determined to be 1037 which represents a slight decrease in the ballistic performance compared to the plate prepared in Example I. This example illustrates the importance of using a Ti-6Al-4V alloy having a high oxygen content beyond the limit specified in the military guidelines.

COMPARATIVE EXAMPLE I

A standard Ti-6Al-4V plate having a thickness of 1.5 inch was prepared by a conventional $\alpha+\beta$ process, (i.e., rolled below beta-transus). More specifically, the Ti-6Al-4V plate was formed by heating at 955° C. for 4 hr. The oxygen content of this Ti-6Al-4V was 0.10% which is within the limit specified by the military.

Table I shows the physical properties of this armor plate. The normalized ballistic rating, $V_N$, of this plate was determined to be 1001 whereas the tensile strength (UTS) and the yield strength (YS) in the longitudinal direction were 136 KSI and 124 KSI, respectively. Similar values for the UTS and YS on the same armor plate were reported in the transverse direction.

Quite unexpectedly, the ballistic performance of this Ti-6Al-4V plate prepared by the conventional $\alpha+\beta$ process was lower than the value obtained in Example I. These results clearly demonstrate that improved ballistic performance of a Ti-6Al-4V plate can be achieved by utilizing a high oxygen, $\beta$-processed plate.

COMPARATIVE EXAMPLE II

A 1.5 inch Ti-6Al-4V armor plate was processed in accordance with the procedure described in Comparative Example I, however, the oxygen content of this material was 0.15%.

The physical properties of this Ti-6Al-4V plate is illustrated in Table I. The ballistic rating for this plate was the same as that reported for Comparative Example I. This data compared to Example I once again illustrates that improved ballistic performance can be achieved by the instant invention. That is, improved ballistic performance of a titanium base alloy can be achieved by using a high oxygen content composition and by $\beta$-processing the oxygen-rich material at temperatures within the $\beta$-field phase.

COMPARATIVE EXAMPLE III

A 1.5 inch Ti-6Al-4V armor plate was processed in accordance with the procedure described in Comparative Example I, however, the $O_2$ content of the alloy was beyond the military specified limit of 0.20%. This comparative example was conducted to illustrate the importance of utilizing temperatures within the beta phase field.

The data for this armor plate is shown in Table I. The normalized ballistic rating, $V_N$, of this Ti-6Al-4V plate having an $O_2$ content of 0.22% processed by the low temperature $\alpha+\beta$ process was determined to be 1031. This value is higher than any of the previous comparative examples however the value is still lower than that reported for Example I. The reason for this slight increase is unsure but the results of this comparative example once again illustrate that the best ballistic performance can be obtained by using the inventive process.

TABLE I

PROPERTIES OF Ti—6Al-4 V 1.5-INCH PLATE

| EXAMPLE | PROCESS | $O_2$, % | TEST DIRECTION[a] | UTS[b], KSI | YS[c], KSI | EL[d], % | NORMALIZED BALLISTIC RATING, $V_N$ |
|---|---|---|---|---|---|---|---|
| 1 | $\beta$ | 0.22 | L | 142 | 126 | 11 | 1046 |
| | | | T | 147 | 135 | 12 | |
| 2 | $\beta$ | 0.15 | L | 140 | 126 | 16 | 1037 |
| | | | T | 147 | 137 | 15 | |
| CE 1 | $\alpha+\beta$ | 0.10 | L | 136 | 124 | 15 | 1001 |
| | | | T | 131 | 119 | 16 | |
| CE 2 | $\alpha+\beta$ | 0.15 | L | 143 | 131 | 16 | 1001 |
| | | | T | 141 | 128 | 15 | |
| CE 3 | $\alpha+\beta$ | 0.22 | L | 146 | 132 | 15 | 1031 |
| | | | T | 147 | 135 | 14 | |

[a]Test direction either in longitudinal (L) or transverse (T) direction
[b]Tensile strength of sample
[c]Yield strength of sample
[d]Elongation

What is claimed:

1. An improved method for providing equivalent or superior ballistic performance of Ti-Al-4V armor plates, which comprises:
   (a) providing a titanium alloy wherein the composition limits of said titanium alloy are 5.5 to 6.75% Al; 3.5 to 4.5% V; 0.20 to 0.30% $O_2$; 0.50 Max. Fe; and 0.50% Max. of other impurities;
   (b) $\beta$-processing said titanium alloy by heating said alloy to a temperature within the beta phase field and then working said alloy; and
   (c) cooling said worked alloy to room temperature.

2. The method of claim 1 wherein the composition of the titanium alloy is 6.2% Al; 4.0% V and 0.25% $O_2$.

3. The method of claim 1 wherein in step (a) the titanium alloy is melted by employing a single melt hearth process and then cooled to a solid.

4. The method of claim 1 wherein the titanium alloy is $\beta$-processed at temperatures from about 990° to about 1200° C. for about 1 to about 12 hrs.

5. The method of claim 1 wherein the $\beta$-processed titanium alloy is rolled into a plate.

6. The method of claim 3 wherein the single melt hearth process is conducted using a single electron beam energy source.

7. The method of claim 3 wherein the titanium alloy is single melted into a shape suitable for further processing.

8. The method of claim 4 wherein the titanium alloy is $\beta$-processed at temperatures from about 1050° to about 1100° C. for about 3 to about 6 hrs.

9. The method of claim 5 wherein the plate is rolled to a thickness from about 3/16 inches to about 6 inches.

10. The method of claim 6 wherein the single melt hearth process is conducted under vacuum or an inert gas atmosphere.

11. The method of claim 8 wherein the titanium alloy is $\beta$-processed at 1075° C. for 4 hrs.

12. The method of claim 9 wherein the plate is rolled to a thickness from about 1 to about 3 inches.

13. The method of claim 12 wherein the plate is rolled to a thickness of about 1.5 inches.

* * * * *

UNITED STATES PATENT AND TRADEMARK OFFICE

CERTIFICATE OF CORRECTION

PATENT NO. : 5,332,545
DATED : July 26, 1994
INVENTOR(S) : William Love

It is certified that error appears in the above-indentified patent and that said Letters Patent is hereby corrected as shown below:

On the Title Page, Section [56], before "4,675,055" insert the following:

--2,754,204 7/1956 Jaffee et al.....75/175.5
2,884,323 4/1959 Abkowitz et al.....75/175.5-- and after "148/670" insert the following:

--4,898,624 2/1990 Chakrabarti et al.....48/669
4,943,412 7/1990 Bania et al.....420/420
5,032,189 7/1991 Eylon et al.....420/420--

Column 8, line 28, Claim 1: "Ti-Al-4V" should read --Ti-6Al-4V--.

Signed and Sealed this
Twenty-eight Day of February, 1995

Bruce Lehman

*Attest:*

BRUCE LEHMAN

*Attesting Officer*

*Commissioner of Patents and Trademarks*